US006615629B2

(12) United States Patent
Bates et al.

(10) Patent No.: US 6,615,629 B2
(45) Date of Patent: Sep. 9, 2003

(54) INTERCONNECTED LOCK WITH DOOR STATUS SENSOR

(75) Inventors: Peter K. Bates, Framingham, MA (US); Alan Doerr, Tomball, TX (US)

(73) Assignee: Schlage Lock Company, Carmel, IN (US)

( * ) Notice: Subject to any disclaimer, the term of this patent is extended or adjusted under 35 U.S.C. 154(b) by 0 days.

(21) Appl. No.: 09/765,784

(22) Filed: Jan. 19, 2001

(65) Prior Publication Data

US 2002/0095957 A1 Jul. 25, 2002

(51) Int. Cl.[7] ..... E05B 39/04

(52) U.S. Cl. ..... 70/434; 70/432; 70/107; 70/DIG. 59

(58) Field of Search ..... 70/107, 432, 434, 70/DIG. 59

(56) References Cited

U.S. PATENT DOCUMENTS 4,196,422 A * 4/1980 Swigert et al. ..... 200/61.64
4,559,796 A * 12/1985 De Forrest, Sr.
4,845,471 A * 7/1989 Chu ..... 200/61.64
4,979,767 A * 12/1990 Lin ..... 292/336.3
5,083,448 A * 1/1992 Karkkainen et al. ..... 292/144
5,325,687 A 7/1994 Lin
5,513,505 A * 5/1996 Dancs ..... 292/169.13
5,655,393 A 8/1997 Kuo et al.
5,657,653 A 8/1997 Hensley et al.
5,713,612 A 2/1998 Kajuch
5,987,945 A * 11/1999 Ruano Aramburu ..... 70/107
6,128,933 A * 10/2000 Mirshafiee et al. ..... 292/244

* cited by examiner

*Primary Examiner*—Anthony Knight
*Assistant Examiner*—Christopher Boswell
(74) *Attorney, Agent, or Firm*—Michael Best & Friedrich LLP

(57) ABSTRACT

A sensor for an interconnected lock assembly which can sense whether the door is in an opened or closed state. The interconnected lock assembly comprises a first lock assembly operably connected to a deadlatch assembly. A second lock assembly operably interconnected with the first lock assembly by a rack mounted on a carrier component. The second lock assembly is operably connected to a deadbolt latch assembly. The deadbolt latch assembly comprises a deadbolt movable between an extended position when the carrier component is in a lowered position and a retracted position when the carrier component is in a raised position. The lock assembly further includes a sensor component positioned within said deadlatch assembly in a predetermined manner to detect when said door is an open or closed position. The information is relayed to an electronic control module.

19 Claims, 8 Drawing Sheets

INTERCONNECTED LOCK WITH DOOR STATUS SENSOR

TECHNICAL FIELD

This invention relates generally to interconnected lock assemblies used to secure doors. More particularly, the present invention relates to an interconnected lock assembly which provides a feature to sense whether the door is open or closed.

BACKGROUND OF THE INVENTION

An interconnected lock assembly is characterized by an inside handle, either knob or lever, which simultaneously retracts both a deadlatch and a deadbolt. Such a lock assembly is commonly found in public accommodations such as hotels and motels in which, for security purposes, the occupant wishes to set both a deadlatch and a deadbolt. The same type of lock assembly may also be found in a residential environment. It is particularly important that both locks be retracted by the turning of a single inside operating member as it has been found that in the event of a fire or other panic situation it is desirable that the occupant only need turn a single knob or lever to operate all of the lock mechanisms in a particular door.

Such interconnected lock assemblies have been on the market for a number of years. Some interconnected lock assemblies are adjustable to compensate for varying distances between the latch assemblies. The adjustable feature is particularly helpful if there is a slight misalignment of the latch assembly bores, or when retrofitting an existing door if the distance between bore centerlines is not the same as the distance between the latch assemblies of the interconnected lock. One prior art design discloses an adjustable interconnected lock which enables interconnection of an exterior assembly that has an adjustable spacing between the exterior dead bolt assembly and a lower lock assembly.

One problem with interconnected lock assemblies is that when leaving, the user can open the door by using just the interior handle, even if the door is locked, but must use a key to lock the door behind them. This can provide an inconvenience especially when the keys are not readily available, the user is carrying objects, the user does not have a key, or the user is in a hurry. Thus the convenience and ease of operation provided by the interconnect lock is lost.

The foregoing illustrates limitations known to exist in present interconnected lock assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

It is therefore an object of the present invention to provide an interconnected lock assembly which can sense whether the door is in a locked or unlocked state. This and other objects of the present invention are provided by an interconnected lock assembly mounted in a door, comprising a first lock assembly operably connected to a deadlatch assembly. A second lock assembly operably interconnected with the first lock assembly by a rack mounted on a carrier component. The second lock assembly is operably connected to a deadbolt latch assembly. The deadbolt latch assembly comprises a deadbolt movable between an extended position when the carrier component is in a lowered position and a retracted position when the carrier component is in a raised position. The lock assembly further includes a sensor component positioned within said deadlatch assembly in a predetermined manner to detect when said door is an open or closed position.

DETAILED DESCRIPTION

Figure 1:
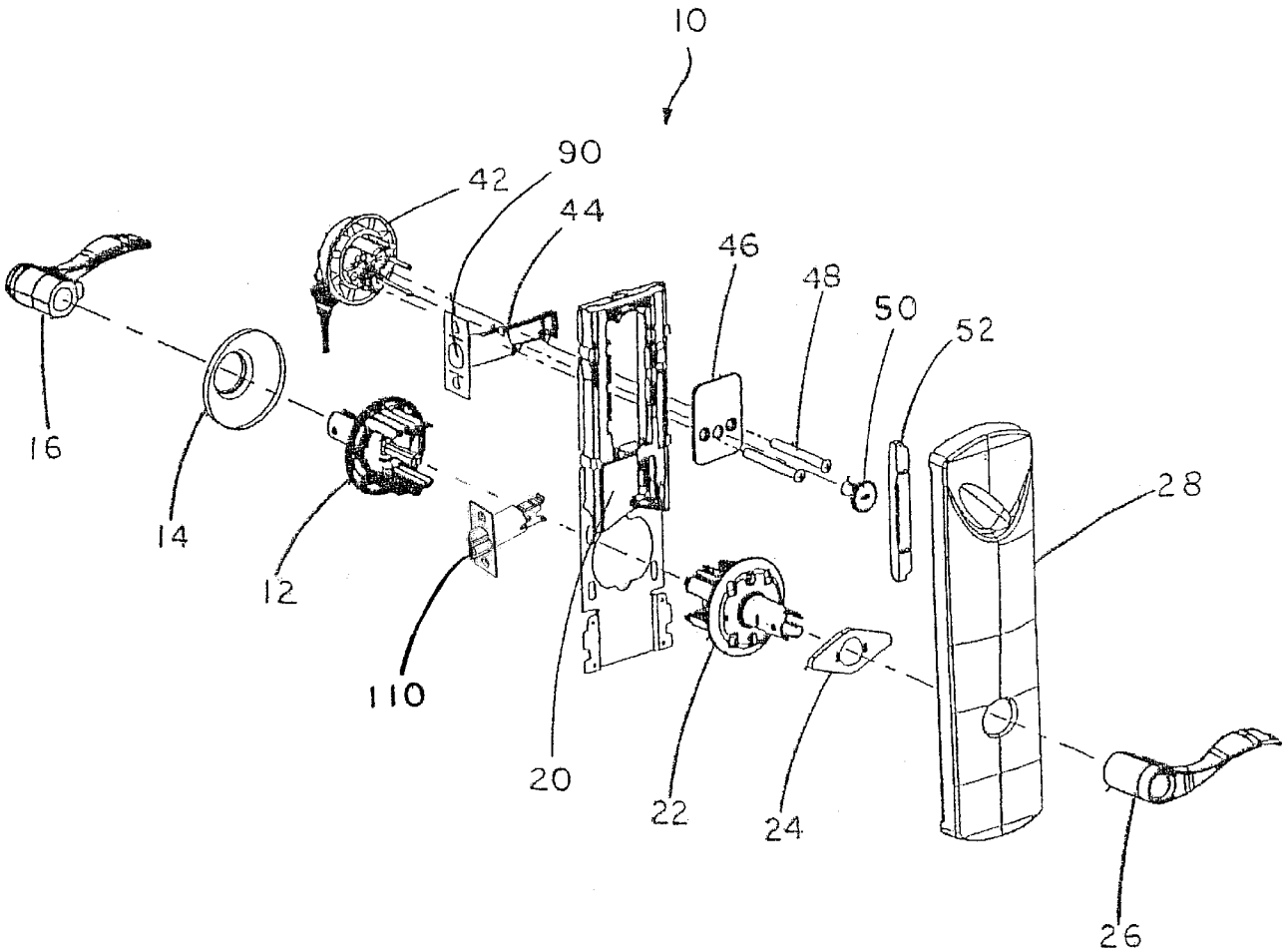
FIG. 1 is an exploded perspective view of the interconnected lock assembly of the present invention.
Figure 2:
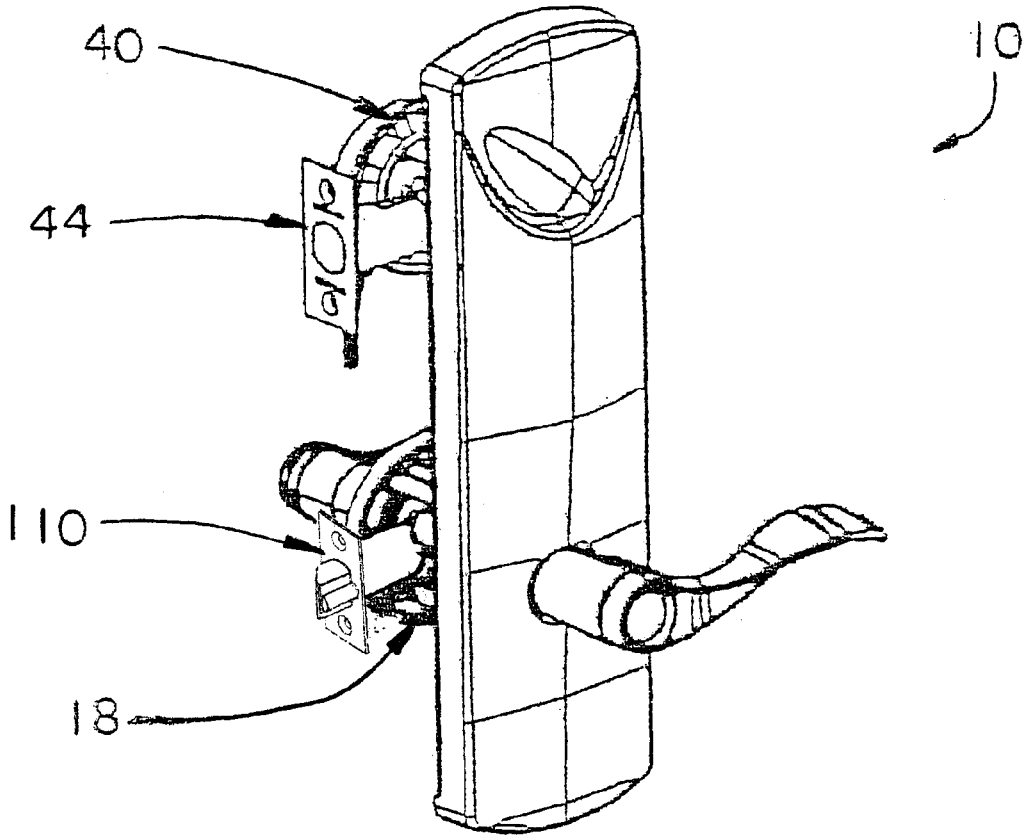
FIG. 2 is a perspective view of the assembled interconnected lock assembly in accordance with the present invention of FIG. 1.

Referring now to the drawings, wherein similar reference characters designate corresponding parts throughout the several views, there is generally indicated at 10 an adjustable interconnected lock assembly with a door status sensor of the present invention. Referring specifically to FIGS. 1 and 2, lock assembly 10 comprises a first or lower interconnected lock assembly 18 comprising outside housing assembly 12, rose 14, and outside knob/lever 16, attached from the outside of a door (not shown) through a first or lower bore in the door, and through a back plate assembly 20 positioned on the inside of the door, to inside housing assembly 22. Interconnect cam 24, escutcheon assembly 28, and inside knob/lever 26 are attached to inside housing assembly 22 on the inside of the door. A deadlatch assembly 110 is operably connected between outside housing assembly 12 and inside housing assembly 22. Interconnected lock assembly 10 also comprises a second or upper interconnected lock assembly 40 comprising a deadbolt housing assembly 42 and a deadbolt latch assembly 44. Deadbolt housing assembly 42 is attached from the outside of the door through a second or upper bore and operably connected to deadbolt latch assembly 44, and through back plate assembly 20 and secured thereto by deadbolt plate 46 and mounting screws 48. Deadbolt housing assembly 42 is operably connected to a deadbolt pinion 50 which engages a deadbolt rack 52 connected to back plate assembly 20 as discussed in detail below. The lower interconnected lock 18 and upper interconnected lock 40 are standard configurations that are well-known in the art, and as such, the workings of these locks will not be described in detail, except as they relate to the present invention.

Figure 3:
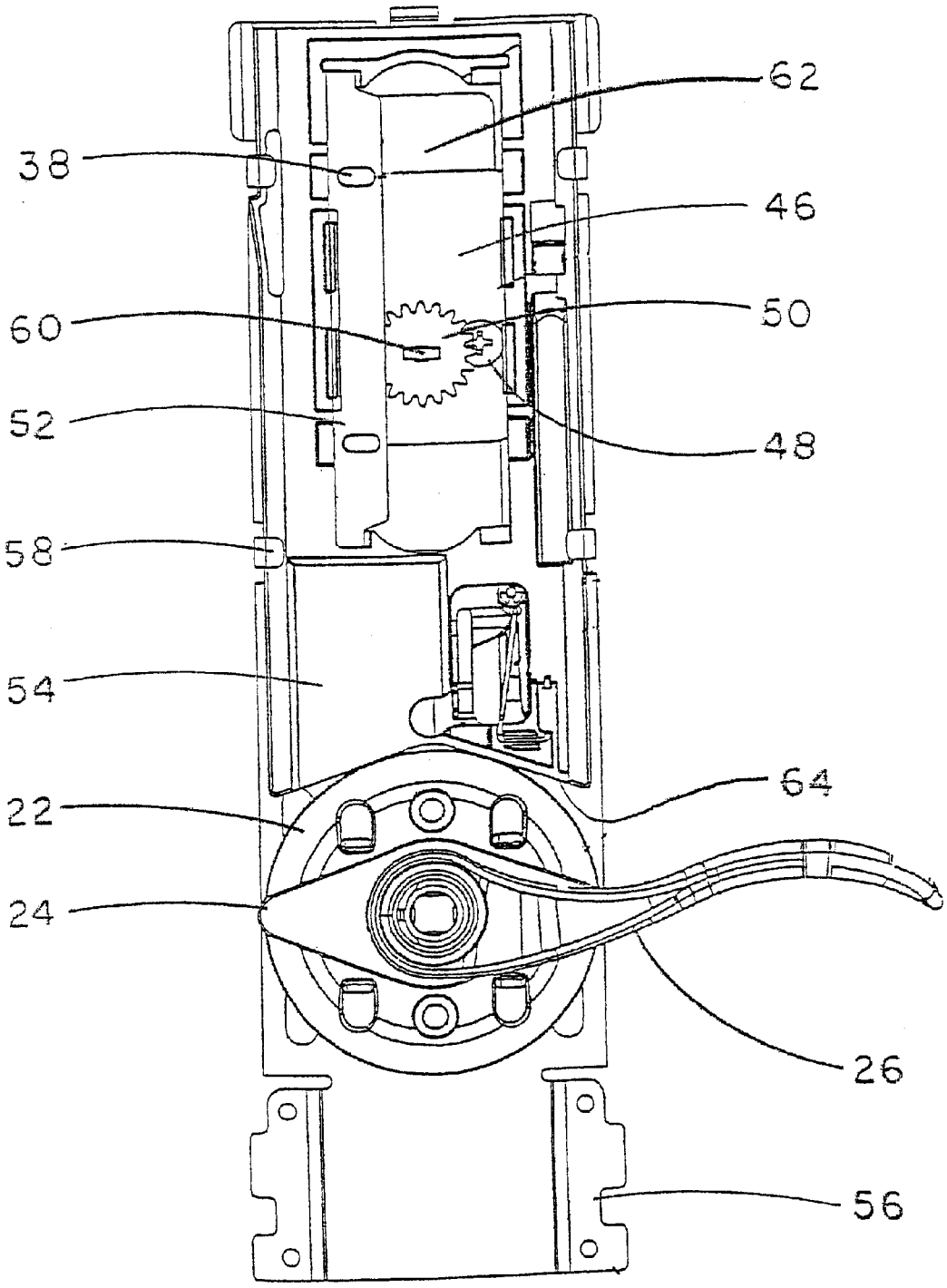
FIG. 3 is a side elevational view of the assembled interconnected lock assembly of FIG. 1, shown without the escutcheon assembly, deadbolt latch assembly, and deadlatch assembly.

Referring now to FIG. 3, interconnected lock 10 shown with escutcheon assembly 28 removed. Back plate assembly 20 comprises a carrier component 54 vertically movable on, and slidably attached to a back plate 56 by a plurality of tangs 58. Deadbolt rack 52 is oriented vertically and fixedly attached to carrier component 54 such that it engages pinion 50. Interconnected lock 10 is adjustable in that upper lock assembly 40 can move up or down to properly fit the upper bore of the door. Deadbolt plate 46 is movable within a slot 62 in back plate 56 to allow the proper positioning of upper lock assembly 40. Upper lock assembly 40 is then secured to deadbolt plate 46 by mounting screws 48 which secure upper lock assembly 40 in a fixed position. Deadbolt assembly 42 is operably connected to deadbolt pinion 50 by a driver bar 60 which is co-rotatingly attached to deadbolt pinion 50. Carrier component 54 is shown in a raised, or unlocked position. When carrier component 54 is in a lowered, or locked position, a mating cam surface 64 of carrier component 54 engages cam 24. Cam 24 is attached to knob/lever 26 in a co-rotating manner such that rotation of knob/lever 26 rotates cam 24 which engages mating cam surface 64, causing carrier component 54 to move vertically, upwardly to a raised, or unlocked position. The rack 52 attached to carrier component 54 causes deadbolt pinion 50 to rotate as carrier component 54 moves either upward or downward. Driver bar 60 co-rotates with deadbolt pinion 50. Rotation of driver bar 60 causes retraction and extension of deadbolt 90 of deadbolt latch assembly 44 in a standard fashion. Accordingly, as carrier component 54 moves upward, deadbolt 90 of deadbolt latch assembly 44 is retracted. It should be noted that when bolt 90 is depressed to a retracted position, deadbolt latch assembly 44 causes rotation of deadbolt pinion 50 in a standard manner, moving carrier component 54 to a raised position.

Figure 4A:
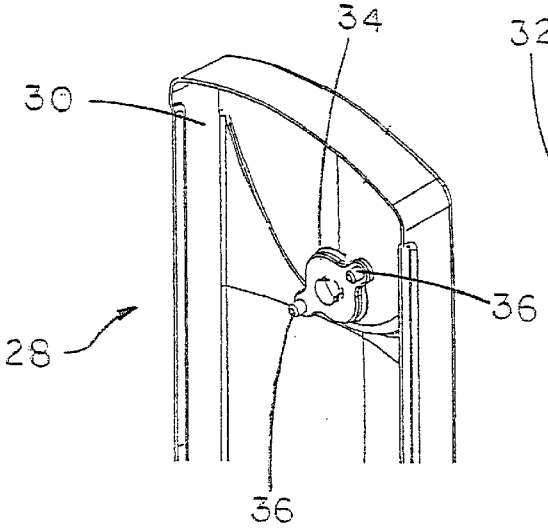
FIG. 4A is an rearward perspective view of the escutcheon assembly, in accordance with the present invention.
Figure 4B:
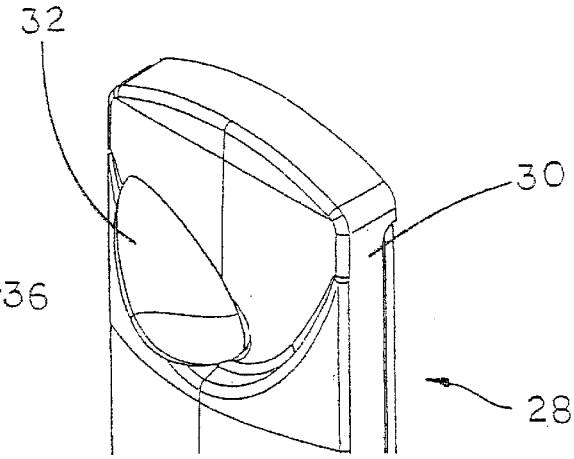
FIG. 4B is an frontal perspective view of the escutcheon assembly, in accordance with the present invention.

Referring now to FIGS. 4A and 4B, escutcheon assembly 28 comprises escutcheon 30, thumbturn 32, and thumbturn link component 34. Thumbturn 32 is coupled to thumbturn link component 34 in a co-rotating manner through an aperture in escutcheon 30. Thumbturn link component 34 comprises at least one pin 36 which engages an aperture 38 in rack 52, linking thumbturn 32 to carrier component 54. It is noted that rack 52 can be positioned on either side of carrier component 54 such that a pin 36 will engage an aperture 38 in rack 52, allowing thumbturn 32 to be appropriately attached for right and left-hand opening doors. Movement of the carrier component 54 results in rotation of thumbturn 32, and conversely, rotation of thumbturn 32 causes movement of carrier component 54 and extension and retraction of said deadbolt 90.

Figure 5:
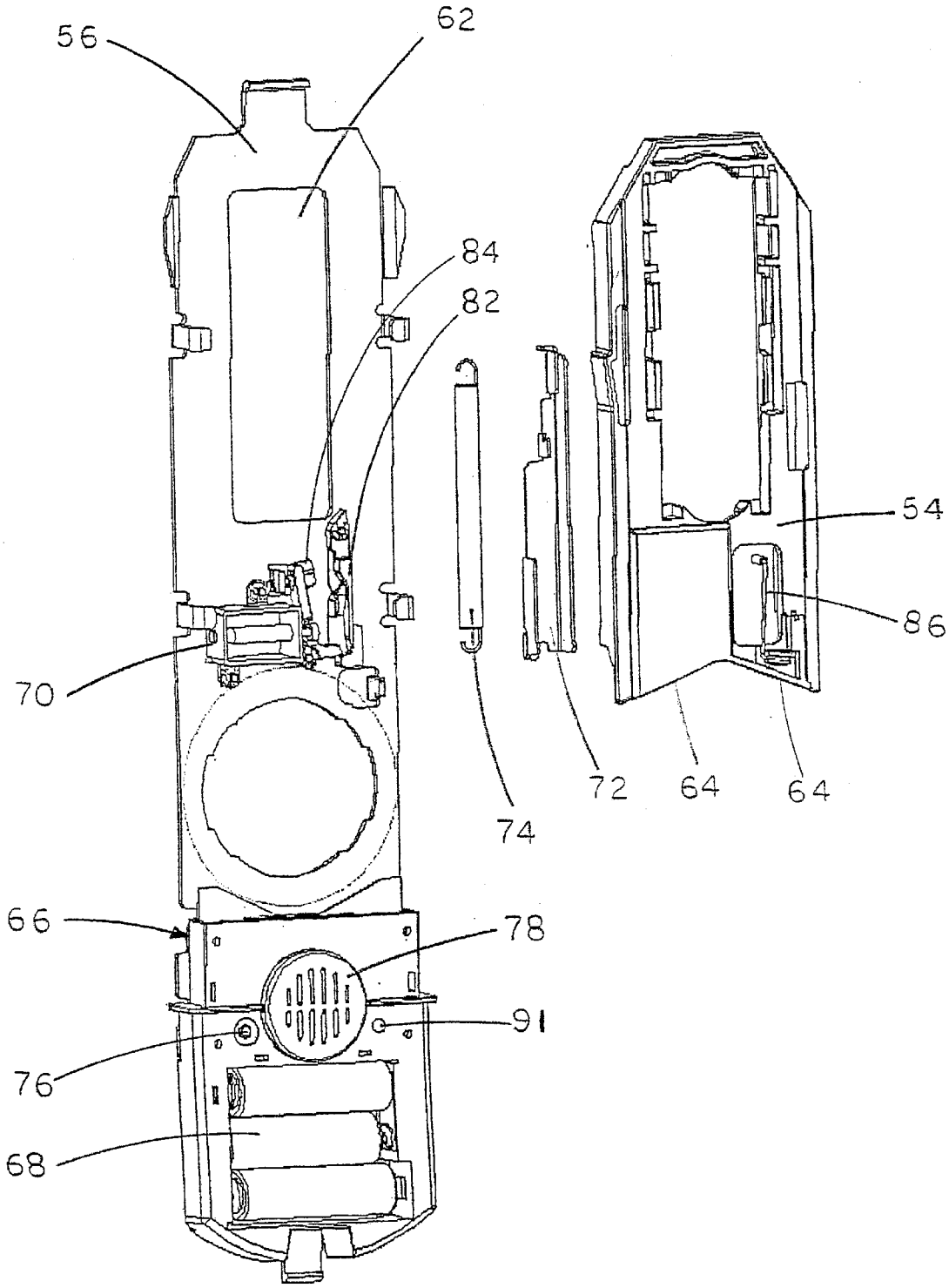
FIG. 5 is an exploded perspective view of the backplate assembly in accordance with the present invention.

Referring now to FIG. 5, the back plate assembly 20 is shown in greater detail. To enable a remote locking function, interconnected lock 10 utilizes carrier component 54 which is biased in a downward, or locked position. Accordingly, a spring carriage 72 is attached to carrier component 54. Spring carriage 72 houses a spring 74 such that one end of spring 74 is attached to the assembled spring carriage 72/carrier component 54 and the other end of spring 74 is fixedly attached to back plate 56. Spring 74 is of sufficient strength to cause carrier component 54 to move downward to locked position and cause extension of deadbolt 90 of deadbolt latch assembly 44. Backplate assembly 20 further comprises an electronic module 66 housing a power component 68 shown as a plurality of batteries to operate an automatic locking solenoid 70 and a signal receiver 75. In order to prevent spring 74 from returning carrier component 54 to a locked position, back plate assembly includes a catch mechanism 80 comprising a catch component 82 and a catch release 84. Catch component 82 and catch release 84 are each pivotally attached to back plate 56 by a pin 88. Catch release 84 is biased toward catch component 82 by catch release spring 83.

The operation of interconnected lock 10 is best described in a dynamic manner starting with carrier component 54 position in a lowered, or locked position. Movement of carrier component 54 from a locked position to an unlocked position can be accomplished by either rotating inside knob/lever 26, rotating thumbturn 32, or by turning a key to rotate the rotating driver bar 60 of deadbolt assembly 42, typically with a key. Movement of carrier component 54 and attached rack 52 causes rotation of pinion 50 and driver bar 60, retracting deadbolt 90 of deadbolt latch assembly 44. At the end of the carrier component 54 travel, the deadbolt 90 of deadbolt latch assembly 44 is fully retracted. Catch release 84, biased by catch release spring 83, forces a tab feature 93 of catch 82 to move underneath spring carriage 72 in a manner locking carrier component 54 in an unlocked position. Spring 74 is now in an extended position, storing energy needed to extend the deadbolt 90.

Figure 9:
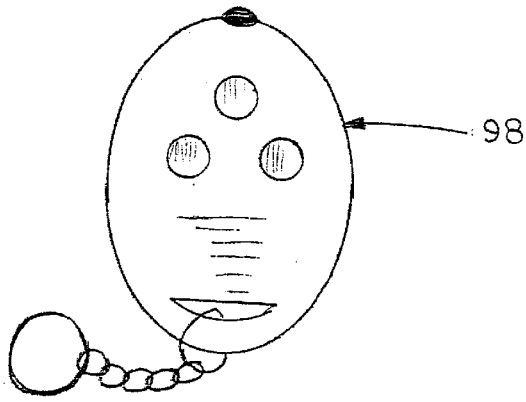
FIG. 9 is a top plan view of the remote locking transmitter used with the remote locking mechanism.
Figure 6B:
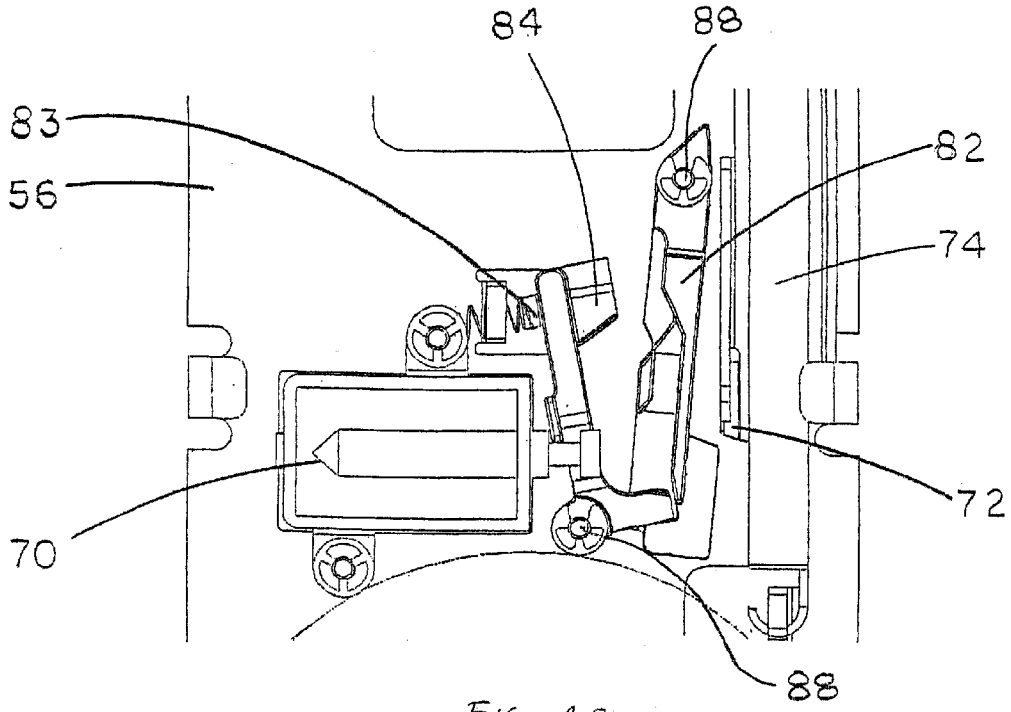
FIG. 6B is a partial side elevational view of the backplate assembly with the carrier component removed, revealing the remote locking mechanism in a disengaged catch position.
Figure 6A:
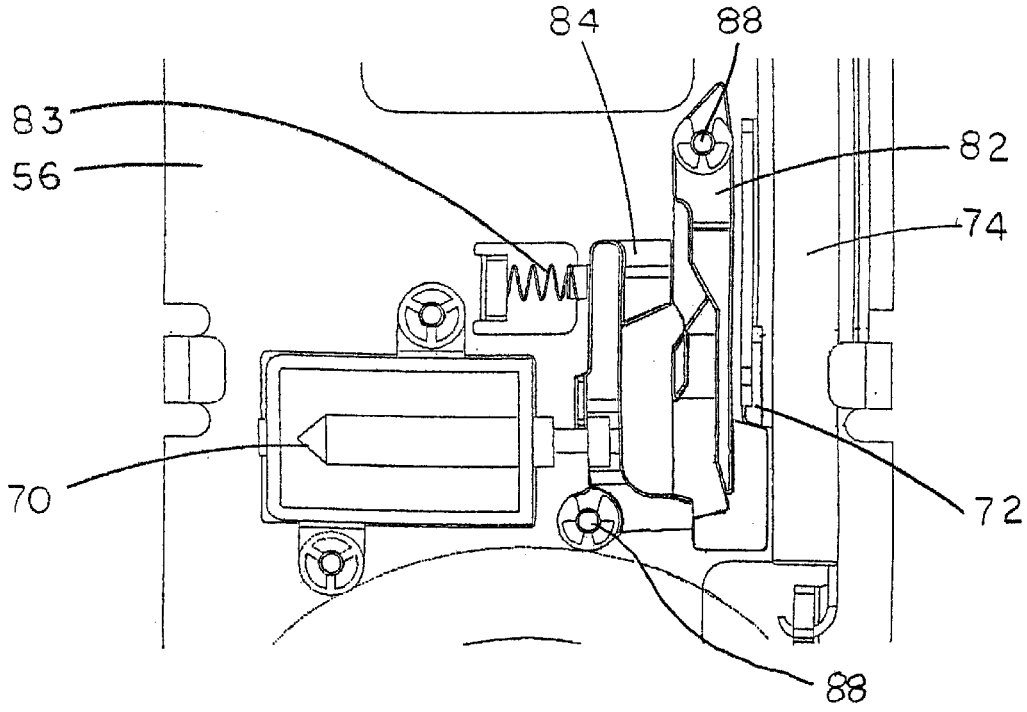
FIG. 6A is a partial side elevational view of the backplate assembly with the carrier component removed, revealing the remote locking mechanism components.

The remote locking feature utilizes solenoid 70 operably connected to catch release 84 as shown in FIG. 6A. A remote signal device 98 is utilized with the remote locking mechanism, shown in FIG. 9 as a standard keychain transmitter of the type used to unlock cars, garages, etc., When the remote locking signal is received by signal receiver 75, solenoid 70 retracts catch release 84, allowing catch component 82 to rotate away from spring carriage component 72, as shown in FIG. 6B. Carrier component 54 is then permitted to move downward under the biasing force of spring 74. As previously described, downward movement of carrier component 54 causes extension of deadbolt 90 of deadbolt latch assembly 44, thus locking the door.

Figure 7:
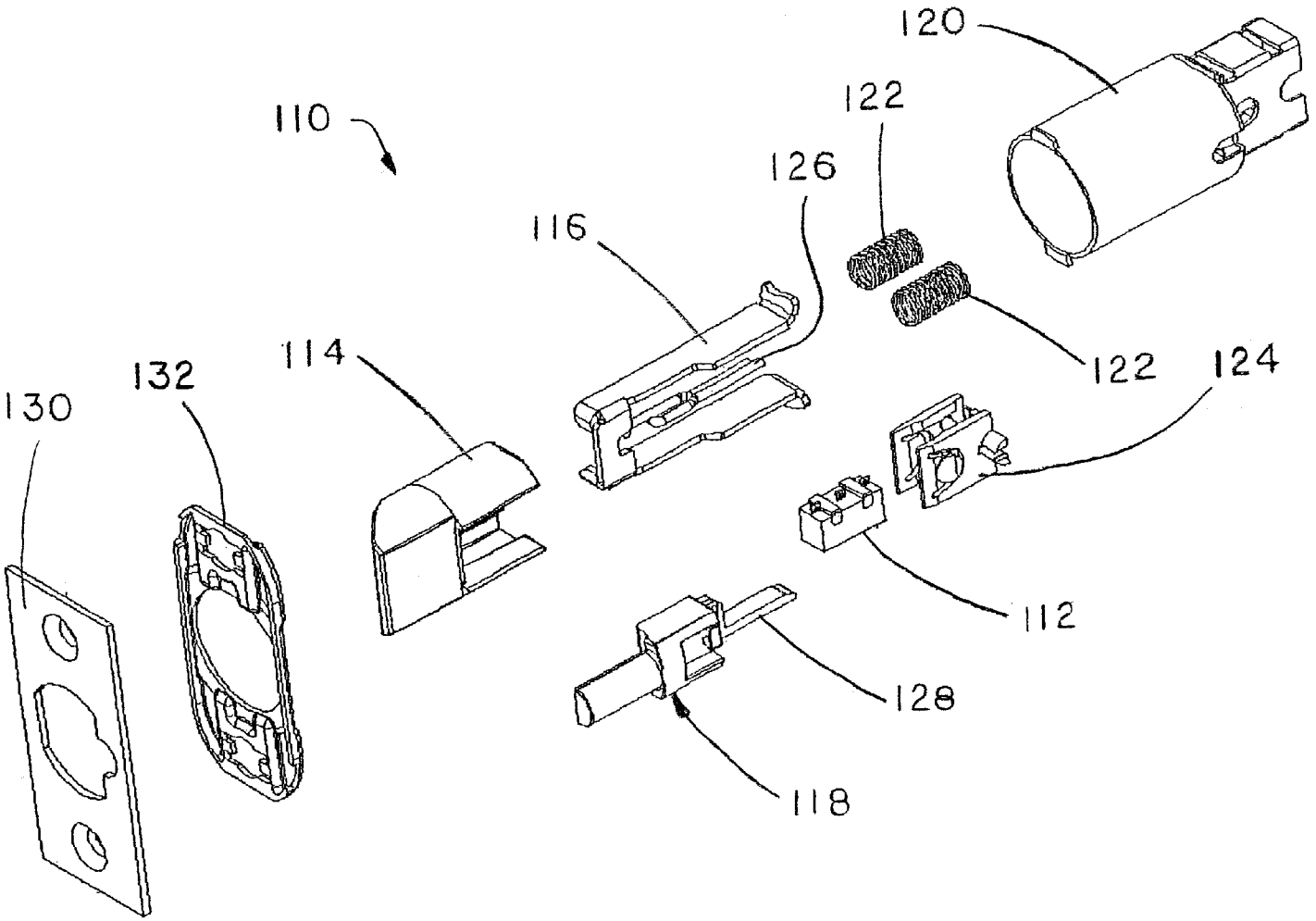
FIG. 7 is an exploded perspective view of the deadlatch assembly including the door position sensor.
Figure 8A:
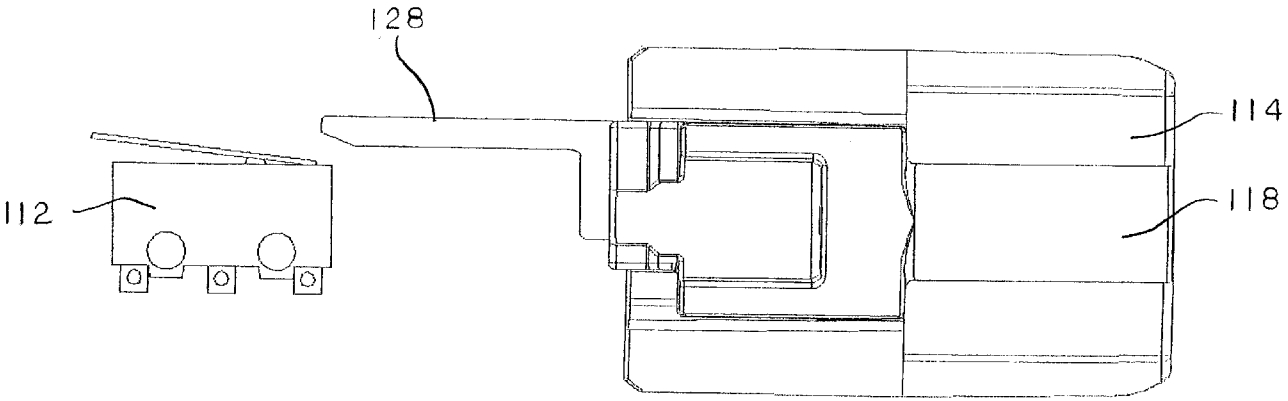
FIG. 8A is a side elevational view of the sensor, bolt and deadlatch plunger in a door open configuration.
Figure 8B:
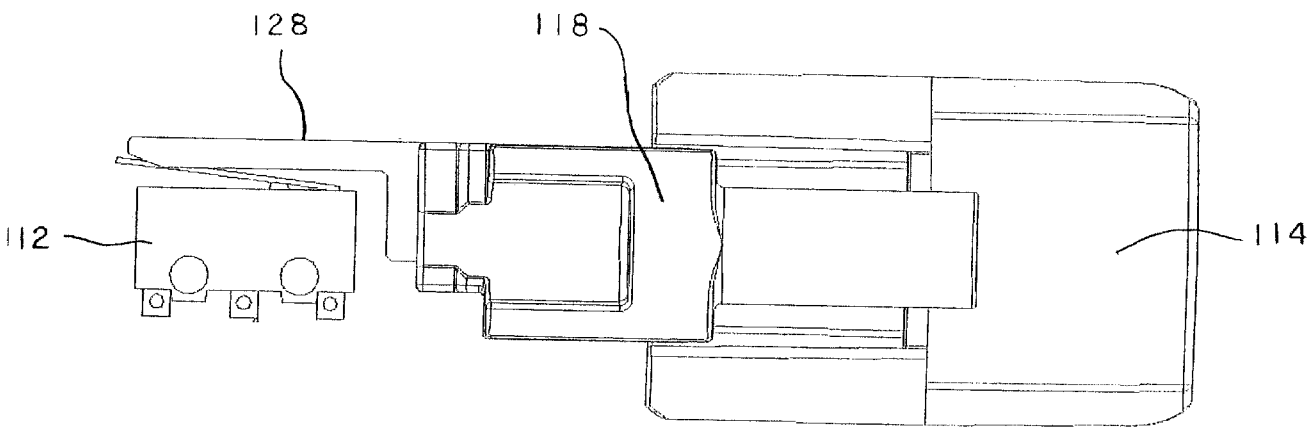
FIG. 8B is a side elevational view of the sensor, bolt and deadlatch plunger in a door oclosed configuration.

If the door is locked when the door is in an opened condition, the deadbolt will prevent the door from closing. In order to prevent accidental locking of the door when the door is opened, the deadlatch assembly 110 includes a sensor 112 to detect whether the door is open or closed. Referring to FIG. 7, deadlatch assembly 110 comprises a bolt 114 connected to a drawbar 116. A deadlatch plunger 118 is slidingly attached to bolt 114. The bolt 114/drawbar 116/deadlatch plunger 118 combination is housed in deadlatch housing 120. Bolt 114 and deadlatch plunger 118 are biased in an extended position through a backplate 132 and a faceplate 130 by springs 122, also positioned within deadlatch housing 120. Sensor 112, shown as a microswitch, is positioned within sensor holder 124 and is electrically connected to electronic control module 66 by wires 126. Sensor 112 and sensor holder 124 are positioned within deadlatch housing 120, behind deadlatch plunger 118. Deadlatch plunger 118 has an extension portion 128 which can engage sensor 112. Operation of sensor 112 is best shown in FIGS. 8A and 8B. In FIG. 8A, bolt 114 and deadlatch plunger 118 are biased in an extended position. Sensor 112 is not engaged by extension portion 128 of deadlatch plunger 118. In this condition, electronic control module 66 identifies the door in an open position. Electronic control module 66 can prevent accidental actuation of the automatic locking feature by blocking power to solenoid 70. In FIG. 8B, bolt 114 is biased in an extended position, but deadlatch plunger 118 is in a retracted position. Sensor 112 is engaged by extension portion 128 of deadlatch plunger 118. In this condition, electronic control module 66 identifies the door in a closed position. Electronic control module 66 can now allow actuation of solenoid 70 upon receiving a signal from transmitter 98.

In addition to providing power to the solenoid 70 and sensor 112, electronic module 66 may also be used to power a speaker 78 which can verbally (or with predetermined beeps) give the opened or closed status of the door at predetermined times such as upon closing the door, opening the door, after unlocking the door, or upon receiving a signal from a remote operating device 98. Electronic module 66 may also comprise status lights 91 indicating a color corresponding to the open or closed status of the door. When the door is in an open condition, electronic module 66 may prevent operation of automatic locking solenoid 70 and/or transmit a status signal to remote operating device 98.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. An interconnected lock assembly mounted in a door, comprising:

a first lock assembly operably connected to a deadlatch assembly, said deadlatch assembly having a deadlatch;

a second lock assembly operably interconnected with said first lock assembly by a rack mounted on a carrier component;

a sensor component positioned within said deadlatch assembly in a predetermined manner to detect when said door is an open or a closed position; and a deadholt latch assembly operably connected to said second lock assembly, said deadbolt latch assembly including a deadbolt movable between an extended position when said carrier component is in a lowered position and a retracted position when said carrier component is in a raised position; and a deadlatch plunger slidingly coupled to said deadlatch assembly and moveable between a retracted position when said door is in said closed position and an extended position when said door is in said open position, wherein when said door is in said closed position, said deadlatch plunger is operable to engage said sensor component, and wherein when said door is in said open position, said deadlatch plunger disengages said sensor to prevent release of said carrier component from said raised position.

2. The interconnected lock assembly of claim 1, wherein said sensor component is a microswitch.

3. The interconnected lock assembly of claim 1, wherein said deadlatch plunger comprises at least one extension which engages said sensor when said deadlatch plunger is in a retracted position.

4. The interconnected lock assembly of claim 2, wherein said at least one extension disengages said sensor when said deadlatch plunger moves from a retracted position to an extended position.

5. The interconnected lock assembly of claim 1 further comprising an electronic control module electrically connected to said sensor component.

6. The interconnected lock assembly of claim 5, wherein said electronic control module comprises at least one light indicating the door position status as either open or closed in a predetermined manner.

7. The interconnected lock assembly of claim 5, wherein said electronic control module further comprises at least one speaker indicating the door position status as either open or closed in a predetermined manner.

8. The interconnected lock assembly of claim 5, wherein said electronic control module further comprises a power source.

9. The interconnected lock assembly of claim 8, wherein said power source comprises at least one battery.

10. An interconnected lock assembly mounted in a door comprising:

a first lock assembly operably connected to a deadlatch assembly;

a second lock assembly operably connected with said first lock assembly by a rack mounted on a carrier component, wherein said second lock assembly is operably connected to a deadbolt latch assembly, said deadbolt latch assembly comprising a deadbolt movable between an extended position when said carrier component is in a lowered position and a retracted position when said carrier component is in a raised position;

a biasing component biasing said carrier component toward a lowered position; and a catch biased by a spring component to hold said carrier component in said raised position;

a sensor component positioned within said deadlatch assembly in a predetermined manner to detect when said door is an open or closed position; and an electronic control module operably attached to a solenoid, said solenoid selectively engageable to disengage said catch component allowing said carrier component to move to a lowered position.

11. The interconnected lock assembly of claim 10, wherein said sensor relays said detected door position of said carrier component to said electronic control module.

12. The interconnected lock assembly of claim 10, wherein said deadbolt latch assembly comprises a deadlatch plunger moveable between a retracted position when said door is closed and an extended position when said door is open.

13. The interconnected lock assembly of claim 10, wherein said deadlatch plunger comprises at least one extension which engages said sensor when said deadlatch is in a retracted position.

14. The interconnected lock assembly of claim 10, wherein said electronic control module prevents engagement of said solenoid when said sensor detects said deadlatch plunger in an extended position.

15. The interconnected lock assembly of claim 10, wherein said sensor component is a microswitch.

16. The interconnected lock assembly of claim 14, wherein said at least one extension disengages said sensor when said deadlatch plunger moves from a retracted to an extended position.

17. The interconnected lock assembly of claim 10, wherein said electronic control module comprises at least one light able to indicate the door position status as either open or closed in a predetermined manner.

18. The interconnected lock assembly of claim 10, wherein said electronic control module further comprises at least one speaker able to indicate the door position status as either open or closed in a predetermined manner.

19. An interconnected lock assembly mounted in a door comprising:

a first lock assembly operably connected to a deadlatch assembly; and a second lock assembly, operably interconnected with said first lock assembly by a rack mounted on a carrier component, said second lock assembly operably connected to a deadbolt latch assembly, said deadbolt latch assembly having a deadbolt movable between an extended position when said carrier component is in a lowered position and a retracted position when said carrier component is in a raised position, wherein said deadlatch assembly is coupled to a deadlatch plunger moveable between a retracted position when said door is in a closed position and an extended position when said door is an open position, wherein said deadlatch plunger includes at least one extension positioned to engage a sensor component housed within said deadlatch assembly when said door is in said closed position, and wherein when said door is in said open position, said extension of said deadlatch plunger disengages said sensor to prevent release of said carrier component from said raised position.

* * * * *